United States Patent [19]

Nobuo et al.

[11] Patent Number: 4,759,329

[45] Date of Patent: Jul. 26, 1988

[54] THROTTLE VALVE CONTROL APPARATUS FOR AN ENGINE

[75] Inventors: Takeuchi Nobuo; Kaneko Tadashi; Nakazumi Tadataka; Hotate Makoto, all of Hiroshima, Japan

[73] Assignee: Mazda Motor Corporation, Hiroshima, Japan

[21] Appl. No.: 886,226

[22] Filed: Jul. 16, 1986

[30] Foreign Application Priority Data

Jul. 16, 1985 [JP] Japan ..... 60-155241

[51] Int. Cl.[4] ..... F02D 9/02

[52] U.S. Cl. ..... 123/440; 123/399; 123/478

[58] Field of Search ..... 123/585, 586, 440, 489, 123/339, 478, 399, 589

[56] References Cited

U.S. PATENT DOCUMENTS 4,552,116 11/1985 Kuriowa ..... 123/440

4,593,663 6/1986 Atago ..... 123/440

*Primary Examiner*—Ronald B. Cox

*Attorney, Agent, or Firm*—Wegner & Bretschneider

[57] ABSTRACT

An air-fuel ratio of a gas mixture supplied to a vehicle engine is changed according to predetermined operating conditions. A throttle valve arranged in an intake passage to adjust an intake amount is electromagnetically controlled. If the air-fuel ratio is changed, the throttle opening characteristic for the accelerator position is changed, thereby preventing variations in engine output even if the air-fuel ratio is changed.

24 Claims, 7 Drawing Sheets

THROTTLE VALVE CONTROL APPARATUS FOR AN ENGINE

BACKGROUND OF THE INVENTION

I. Field of the Invention

The present invention relates to a throttle valve control apparatus for an engine and, more particularly, to a throttle valve control apparatus for an engine wherein an air-fuel ratio of a gas mixture supplied to the engine is changed, and a throttle valve disposed in an intake passage is electromagnetically controlled.

II. Description of the Prior Art

In most engines, especially internal combustion engines designed for use on automobiles, requiring various operating states, air-fuel ratios have been controlled and changed according to predetermined conditions in recent years. The air-fuel ratio is set to be large (i.e., a lean mixture) during cruising under a small load requiring no high output, while the air-fuel ratio is set to be small, i.e., a rich mixture, during cruising under a large load requiring a high output.

In Otto engines using gasoline, LPG, alcohol, etc., as fuel, a throttle valve is pivotally disposed in an intake passage to control the amount of a gas mixture by adjusting a throttle opening. In general, the throttle valve is mechanically coupled to an accelerator operated by a driver through a linkage such as a wire. In other words, an accelerator position is proportional to a throttle opening so that the throttle opening can be determined solely as a function of the accelerator position. The term "accelerator position" referred to in this specification means a position of an accelerator or an amount operated thereby, relative to the position thereof at which or in the amount in which the accelerator is not operated, expressed in percentage, and it is given as 0% when the accelerator is not operated and as 100% when it is operated to the maximum extent. The term "throttle opening" referred to herein means a ratio of a given angular position of a throttle valve to an angular position of the fully open throttle valve if the fully closed position of the throttle valve is given as 0% and the fully open position of the throttle valve is given as 100%.

U.S. Pat. Nos. 4,112,885 and 4,168,679 describe electromagnetic throttle valve control apparatuses in place of mechanical ones. In an electromagnetic apparatus, an accelerator pedal is electromagnetically coupled to a corresponding throttle valve. More specifically, U.S. Pat. No. 4,112,885 discloses an arrangement for optimally controlling a throttle valve using a reversible drive motor according to accelerator positions and throttle openings, while the throttle valve is driven by the reversible drive motor.

In the electromagnetic control apparatus described in U.S. Pat. No. 4,112,885, a fuel injection quantity is determined according to the accelerator position, and a target amount of intake air is determined according to the determined fuel injection quantity, thereby controlling the throttle opening so as to obtain the target amount of intake air. In addition, the fuel injection quantity and an engine speed are used as parameters for determining the target amount of intake air. Further, an air-fuel sensor detecting an air-fuel ratio in the exhaust gas is used to control the throttle opening, i.e., an amount of intake air by feeding back the detected air-fuel ratio so as to obtain a desired air-fuel ratio.

If output changes are to be caused by changes in air-fuel ratio, an output at a small air-fuel ratio (the rich mixture) is higher than that at a large air-fuel ratio (the lean mixture). In a conventional engine of the type of which the air-fuel ratio is changed according to predetermined operating conditions, considerably large variations in output may be caused upon changes in air-fuel ratio. In other words, even if the driver keeps the opening of the accelerator, i.e., accelerator position, at an identical level, the engine output varies upon changes in air-fuel ratio. Therefore, output variations cause the driver discomfort. This feeling of discomfort that may be caused by variations in air-fuel ratio may occur as difference in the feeling of engine power even during the traveling after changes of the air-fuel ratios, and this tendency is likely to be remarkable when the engine is accelerated, in particular when it is started.

SUMMARY OF THE INVENTION

It is a first object of the present invention to provide a throttle valve control apparatus for an engine, wherein differences of engine outputs that follow differences in air-fuel ratio hardly occur as long as the opening or position of an accelerator is at a given position.

It is a second object of the present invention to provide a throttle valve control apparatus for an engine, wherein engine output variations caused by changes in air-fuel ratio can be prevented by new characteristics of throttle openings as a function of the accelerator position.

It is a third object of the present invention to provide a throttle valve control apparatus for an engine, wherein engine output variations caused by changes in air-fuel ratio can be prevented while a load acting on a control system is minimized.

The present invention is fundamentally achieved by the arrangement defined in claim 1. A practical implementation as an air-fuel changing means is defined as in claim 2 or in FIG. 12. According to the arrangement as defined herein, the throttle valve control apparatus according to the present invention produces the engine output substantially at a constant level by controlling the throttle opening, i.e., the amount of intake air according to an air-fuel ratio change even if the air-fuel ratio is changed at the given accelerator position.

Predetermined operating conditions for the changes in air-fuel ratio can be set on the basis of engine operating conditions such as conditions based on the engine load, and conditions based on engine cooling water temperature or on the warm-up state of the engine. These predetermined conditions can also be set by a switch operated manually by the driver. In addition, the predetermined operating conditions can be compatible with conditions changing all conventional air-fuel ratios for obtaining a rich mixture during acceleration.

The number of air-fuel ratios is not limited to two, but it may be extended to three or more. The possible values of the air-fuel ratio include those of a theoretical or stoichiometric air-fuel ratio, a ratio representing a richer mixture than that of the theoretical or stoichiometric air-fuel ratio, or a ratio representing a leaner mixture than that of the theoretical air-fuel ratio.

A fuel supply means may be a carburator or a fuel injection valve. In this case, the fuel injection valve capable of accurately controlling the fuel injection quantity is preferred. Control of the amount of fuel injected from the fuel injection valve can be conveniently achieved by controlling the width of a drive (valve opening) pulse supplied to the fuel injection valve. The pulse width may be controlled by controlling the pulse duty cycle or by other means.

In order to change a throttle opening or target throttle opening according to the air-fuel ratio, it is preferred to calibrate air-fuel ratios other than the target air-fuel ratio by correcting the target throttle opening from a reference throttle opening corresponding to a specific air-fuel ratio or target air-fuel ratio, prestored in a memory means. Compared with an arrangement wherein all throttle openings respectively corresponding to the air-fuel ratios are stored, a small memory can be used to prevent the control system from being overloaded.

From the view of decreasing the load of the control system and simplifying control procedures, the following alternative may be employed. Even if three or more air-fuel ratios can be used, they may be classified into a relatively rich first air-fuel ratio and a relatively lean second air-fuel ratio, and two throttle openings are preferably used in correspondence with the first and second air-fuel ratios. A combination of the two throttle openings and the calculation described above is most preferable. However, if a large-capacity memory is used, all throttle openings respectively corresponding to the air-fuel ratios can be stored in such a memory.

If throttle opening characteristics are provided for the first and second air-fuel ratios, the reference for these ratios is the theoretical air-fuel ratio (=14.7) as the reference for cleaning the exhaust gas. The air-fuel ratio smaller than the theoretical air-fuel ratio is defined as the first air-fuel ratio (the rich mixture) and the air-fuel ratio larger than or equal to the theoretical air-fuel ratio is defined as the second air-fuel ratio (the lean mixture). Open loop control can be performed for all target air-fuel ratios so as to obtain the target air-fuel ratio. However, feedback control can be performed for at least specific target air-fuel ratios. Feedback control is preferable where the air-fuel ratio is greater than or equal to the theoretical air-fuel ratio because of the cleaning of exhaust gases when the air-fuel ratio is equal to the theoretical air-fuel ratio and from the viewpoint of combustion stability when the air-fuel ratio is an air-fuel ratio (the lean mixture) larger than the theoretical air-fuel ratio. In addition, if feedback control is to be performed for both the theoretical air-fuel ratio and an air-fuel ratio (the lean mixture) larger than the theoretical air-fuel ratio, a so-called lean sensor can be used as an air-fuel ratio sensor to generate a signal substantially proportional to an air-fuel ratio in the exhaust gases. If feedback control is to be performed for only the theoretical air-fuel ratio, an $O_2$ sensor can be used as an air-fuel sensor to generate an ON/OFF signal with respect to the theoretical air-fuel ratio.

Upon starting the engine, the driver often unnecessarily operates the accelerator. In this case, the target throttle opening can be determined by a throttle opening corresponding to the second air-fuel ratio regardless of the target air-fuel ratio so as to achieve effective fuel conservation. Similarly, the target throttle opening may be determined according to a start throttle opening larger than that corresponding to the accelerator position. In this case, by increasing the target throttle opening, the driver feels engine power so that excessive operation of the accelerator can be restricted, resulting in fuel conservation. Starting of the automobile may be detected by a vehicle speed, a transmission gear shift position, an accelerator position, a speed of an accelerator position change, etc., or a combination thereof.

A throttle valve drive means may be a stepping motor, a DC motor, a negative pressure actuator for electromagnetically controlling a negative pressure, or the like. In this case, the throttle valve drive means can be feedback controlled so as to obtain the target throttle opening. In order to perform feedback control of the throttle valve drive means, the stepping motor is preferable since a separate sensor for detecting a throttle opening need not be mounted.

The above and other objects, features, and advantages of the present invention will be apparent during a course of the following detailed description in conjunction with the accompanying drawings.

DETAILED DESCRIPTION OF THE PREFERRED EMBODIMENT

Figure 1:
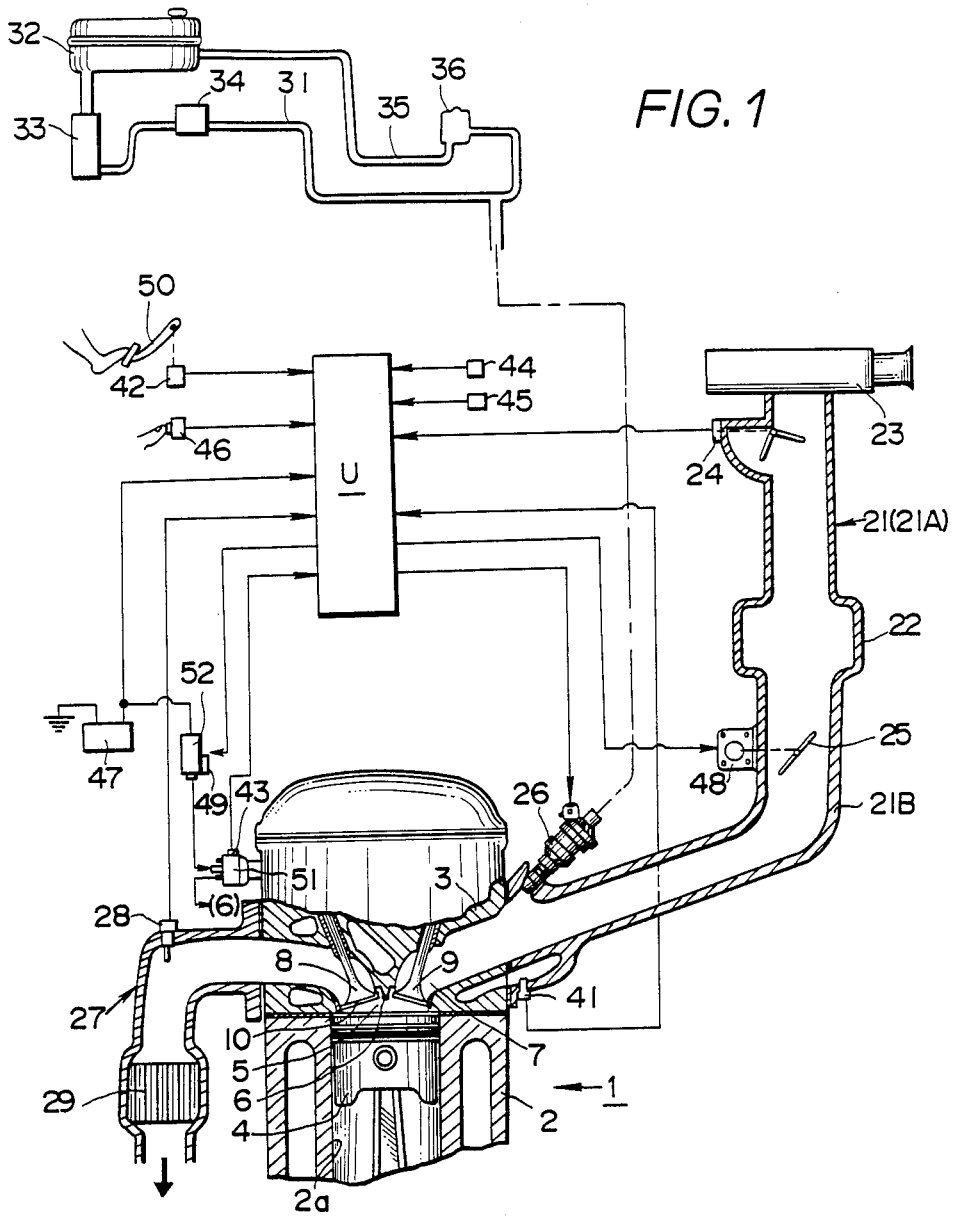
FIG. 1 is a schematic diagram of a throttle valve control apparatus according to an embodiment of the present invention.

Referring to FIG. 1, an engine 1 is an inline (4) type 4-cycle reciprocating Otto engine. The engine 1 includes cylinder blocks 2, cylinder heads 3, and pistons 4 respectively inserted in cylinders 2*a* of the cylinder blocks 2, all of which cooperate to define corresponding combustion chambers 5. In FIG. 1, only one cylinder block is illustrated, but the four cylinders are actually aligned in a direction perpendicular to the surface of FIG. 1. A description will be made by representing the cylinder blocks by the illustrated one. A spark plug 6 extends into the combustion chamber 5. An intake port 7 and an exhaust port 8 are opened to the combustion chamber 5. The ports 7 and 8 are respectively opened/closed by intake and exhaust valves 9 and 10 at predetermined timings in synchronism with the engine output shaft.

A surge tank 22 is formed midway along an intake passage 21 including the intake port 7. An upstream intake passage portion with respect to the surge tank 22 is defined as a single common intake passage portion 21A. An air cleaner 23 and a flap type airflow meter 24 are arranged in the common intake passage portion 21A from the upstream side to the downstream side. A downstream intake passage portion with respect to the surge tank 22 is divided into four independent intake passage portions 21B respectively corresponding to the cylinders. A throttle valve 25 and a fuel injection valve 26 as a fuel supply means are arranged in each downstream intake passage portion 21B from the upstream side to the downstream side.

An air-fuel ratio sensor 28 and a three-way catalyzer 29 for removing NOx. CH and CO in the exhaust gas are arranged in an exhaust passage 27, including the exhause port 8, from the upstream side to the downstream side. The air-fuel ratio sensor 28 is a so-called lean sensor for generating a signal corresponding to an air-fuel ratio (an excess oxygen ratio) of the exhaust gas. It is noted that a conventional loan sensor for generating a signal substantially proportional to the air-fuel ratio has been commercially available.

The fuel injection valve 26 is connected to a fuel tank 32 through a fuel supply path 31. A fuel pump 33 and a filter 34 are connected to the fuel supply path 31. The fuel injection valve 26 is connected to the fuel tank 32 through a return path 35 branched from the fuel supply path 31 at the downstream side of the filter 34. To the return path 35 is connected a fuel pressure regulator 36. When the fuel pump 33 is operated, fuel of a predetermined pressure controlled by the fuel pressure regulator 36 is supplied to the fuel injection valve 26. The quantity of fuel injection that is the air-fuel ratio of the fuel injection valve 26 can be determined by controlling its opening. The opening is determined by controlling a pulse width (e.g., a duty ratio) of an operation signal supplied to the fuel injection valve 26.

A control unit U as shown in FIG. 1 is a digital or analog computer and, more particularly, a microcomputer. The control unit U receives an intake air amount signal from the airflow meter 24, an air-fuel ratio signal from the air-fuel ratio sensor 28, signals from sensors 41, 42, and 43 and switches 44, 45, and 46, and a voltage signal from a battery 47. The control unit U supplies control signals to a stepping motor 48 and an ignitor 49 as well as the fuel injection valve 26.

The sensor 41 detects an engine cooling water temperature or engine warm-up state, and the sensor 42 detects an amount or degree of operation by the accelerator operated by the driver, i.e., the accelerator position and may be constituted by a potentiometer. The sensor 43 may be constituted by, for example, a pickup and is arranged in a distributor 51 to detect an engine speed. The switch 44 detects whether the vehicle speed is zero and is turned off if the vehicle speed is less than, for example, 10 km/h. On the other hand, the switch 45 detects whether a transmission (not shown) is set in the neutral position and can be turned on if the transmission is set in, for example, the neutral position. The switch 46 is a manual switch operated by the driver and serves as a target air fuel ratio determining means for designating a change in air-fuel ratio. In this embodiment, upon operation of the switch 46, the large or small air-fuel ratio (i.e., a lean or rich mixture) can be designated. The stepping motor 48 constitutes a throttle valve drive means for driving the throttle valve 25 and is set at a given angular position corresponding to the number of input pulses.

The ignitor 49 cuts off the primary current of an ignition coil 52 in response to an ignition timing signal from the control unit U. A secondary current induced by the primary current from the ignition coil 52 is supplied to each spark plug 6 through the distributor 51. The switches 45 and 46 may or may not be used according to the modes of operation as will be described hereinafter. The control unit U arranged using the microcomputer basically includes a CPU (Central Processor Unit), a ROM (Read-Only Memory), a RAM (Random Access Memory), and a clock or soft timer. The control unit U also includes an I/O (Input/Output) interface, and an A/D (Analog-to-Digital) or D/A (Digital-to-Analog) converter used according to an analog or digital input signal, a driver, and the like. These components are the same as those of a conventional computer and are known to those skilled in the art so that a detailed description thereof will be omitted. In the ROM in the control unit U is stored a memory map as will be described somewhere hereinbelow.

Air-fuel ratio control and throttle valve control will be made as follows. In this embodiment, the different air fuel ratios are used so that the following operating conditions are given to select the proper air-fuel ratio:

(1) Operating condition based on at least engine load among various engine operating states;

(2) Operating condition set by the switch 46;

(3) Operating condition based on engine warm-up state.

Figure 6:
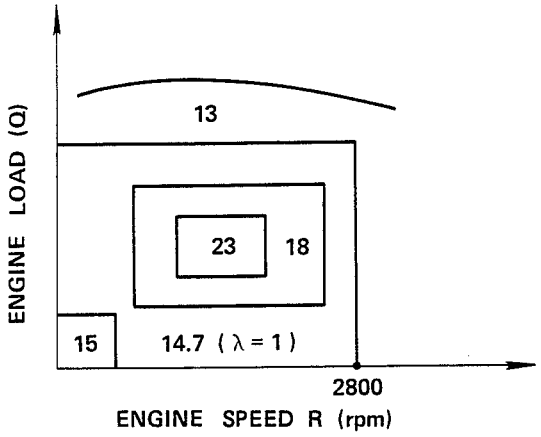
FIG. 6 is a graph showing conditions for the air-fuel ratio.

The operating condition (1) is determined by an engine load as a main factor representing a required engine output, and an engine speed as an auxiliary factor. These factors are used as parameters to divide a load range into a plurality of regions. Air-fuel ratios are respectively assigned to the plurality of regions. More specifically, a map as shown in FIG. 6 is prepared to select an air-fuel ratio (the target air-fuel ratio) corresponding to the current engine operating state by accessing the map. Referring to FIG. 6, five target air-fuel ratios are given as "13", "14.7" (=theoretical air-fuel ratio and an excess oxygen ratio $\lambda=1$), "15", "18", and "23" from the rich mixture side to the lean mixture side.

The operating condition (2) may be set by the switch 46 as described hereinabove. In this case, a target air-fuel ratio of "14.7" or "13" can be manually set.

The operating condition (3) has a priority over the operating conditions (1) and (2) to change the air-fuel ratio. For example, if a cooling water temperature is less than 50° C., the target air-fuel ratio is set to be "13". If a cooling water temperature falls between 50° C. and 70° C., the target air-fuel ratio is set to be "14.7". If a cooling water temperature exceeds 70° C., the warm-up operation is determined to be completed. In this case, the operation condition complies with the operating condition (1).

Figure 7:
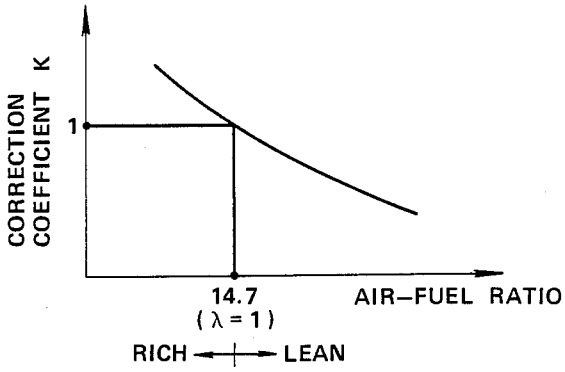
FIG. 7 is a graph showing correction coefficients of amounts of fuel supplied corresponding to other air-fuel ratios with respect to a reference air-fuel ratios.

If the amount of fuel suppled is controlled to achieve the corresponding target air-fuel ratio, the amounts of fuel corresponding to the respective target air-fuel ratios can be stored in a memory means in the form of a map. An amount of fuel supply at a target air-fuel ratio different from the reference target air-fuel ratio (e.g., the theoretical air-fuel ratio where $\lambda=1$) can be calculated by correcting the reference target air-fuel ratio in correspondence with the reference target air-fuel ratio, using a correction coefficient K stored in the map for each target air-fuel ratio, as shown in FIG. 7. The embodiments indicate cases where correction is made as stated hereinabove.

In the embodiments, the following two modes of operations (a) and (b) are given to determine the throttle opening characteristics representing the correspondence between the accelerator position and the throttle opening.

(a) Throttle openings corresponding to all target air-fuel ratios are prestored in the respective memory means as in a map. A memory means corresponding to the desired target air-fuel ratio is selected, and the throttle opening corresponding to the accelerator position is read out from the selected memory means.

Figure 8:
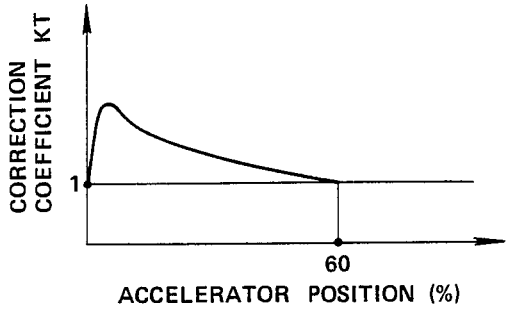
FIG. 8 is a graph showing correction coefficients used to obtain other throttle openings by correcting the reference throttle opening.

(b) A throttle opening corresponding to a reference target air-fuel ratio is defined as a reference throttle opening, and any throttle opening corresponding to a target air-fuel ratio different from the reference one is obtained by correcting the reference throttle opening. In this case, as shown in FIG. 8, the correction values corresponding to the accelerator positions are prestored in a memory means. This operation is preferred because the map only for storing the reference throttle opening is created strictly and a memory means for storing the correction coefficients is prepared with a rough resolution, for example, by every 5% for accelerator positions, thus minimizing effectively the storage capacity of the control unit U.

Figure 3:
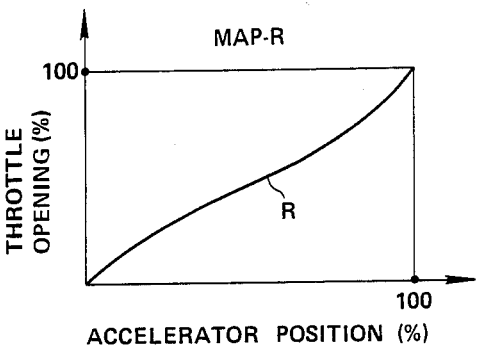
FIG. 3 is a graph showing throttle openings when an air-fuel ratio is small, i.e., the gase mixture is rich.
Figure 4:
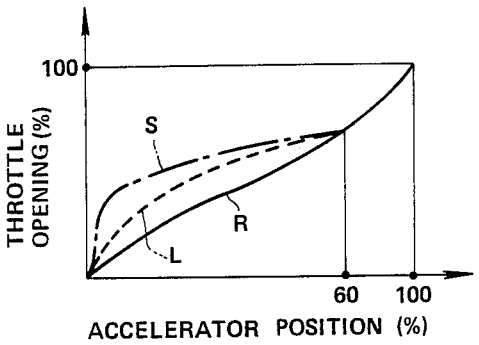
FIG. 4 is a graph showing start throttle opening characteristics taken together with the graphs in FIGS. 2 and 3.
Figure 5:
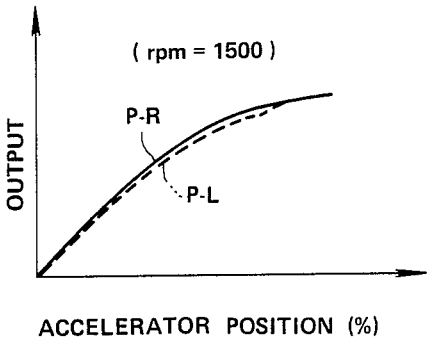
FIG. 5 is a graph showing engine outputs when the air-fuel ratios are large and small, i.e., the gas mixtures are lean and rich, respectively.

The throttle opening for the target air-fuel ratio can be set in units of air-fuel ratios. However, it is possible that different air-fuel ratios which do not cause a large output difference are used as identical throttle openings, thus simplifying control by minimizing the number of throttle openings. In the embodiments which follow, for example, referring to FIG. 6, if air-fuel ratios are less than 14.7, i.e., "13", they are included in a first air-fuel ratio. And a first throttle opening is derived from the first air-fuel ratio. However, if target air-fuel ratio is 14.7 or more, e.g., "15", "18" or "23", a second throttle opening is derived from the second air-fuel ratio common to these target air-fuel ratios. In this manner, the number of throttle openings must be smaller than the number of changeable target air-fuel ratios. Line R representing the first throttle opening characteristics is indicated as the MAP R in FIG. 3, and line L representing the second throttle opening characteristics is indicated as the MAP L in FIG. 2. In order to clarify the difference between the lines L and R, these lines are drawn together in FIG. 4. In an accelerator position range where an engine output difference is increased due to different air-fuel ratios, e.g., in the range of the accelerator positions of not more than 60%, the throttle opening represented by line L is larger than that represented by line R for an identical accelerator position within the above range. Referring to FIG. 5, an output represented by line R is shown as P·R and an output by line L as P·L. As is apparent from FIG. 5, the line P R substantially matches with the line P·L. Therefore, identical accelerator positions may produce identical outputs.

The modes of the operation (a) and (b) for the throttle opening characteristics can be combined with the conditions (1) and (2) for the air-fuel ratio changes, including the condition (3) for the target air-fuel ratio change by the warm-up correction.

The air-fuel ratio control and the throttle control will be described in detail with reference to the flow charts in FIGS. 9 and 10.

Figure 9:
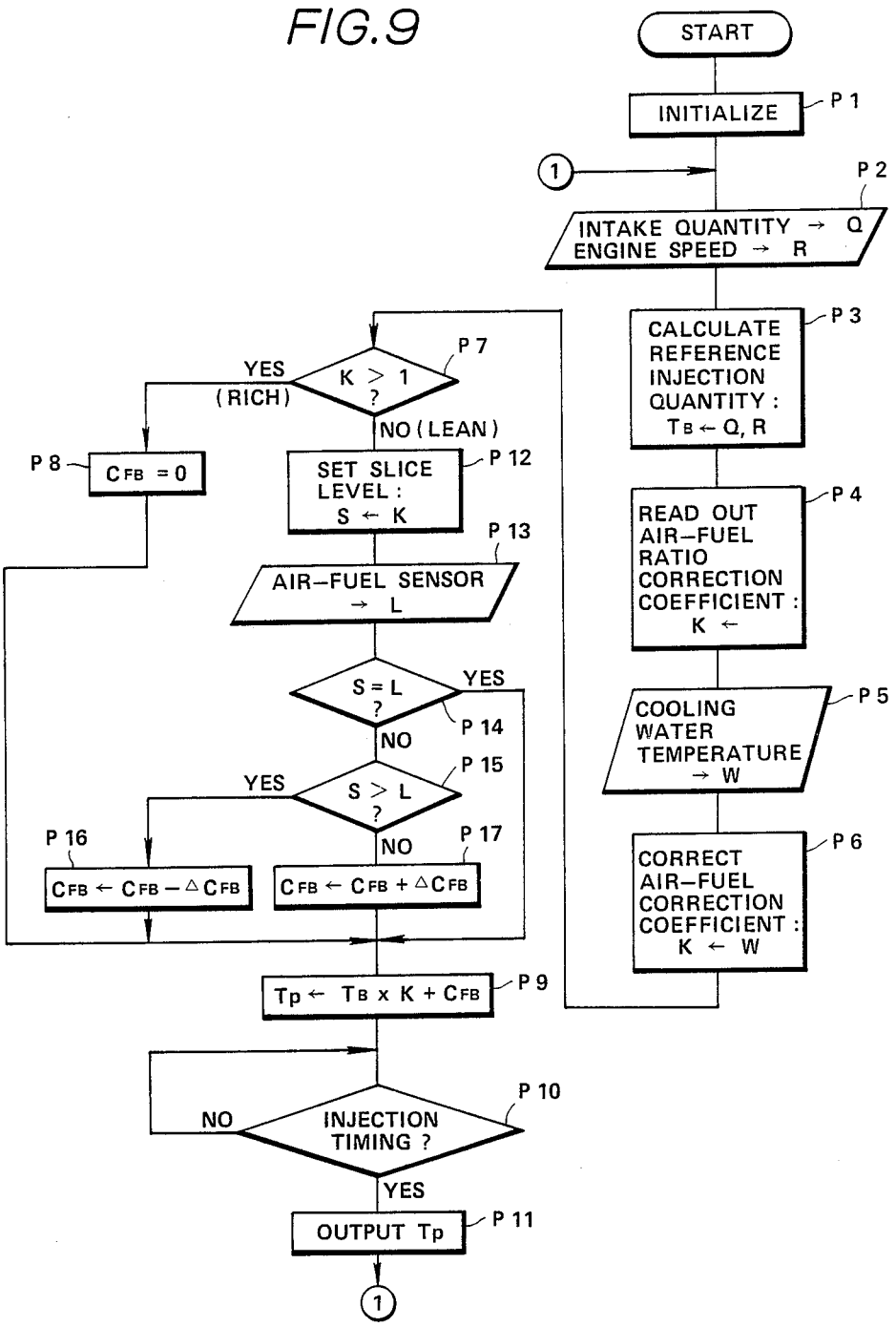
FIGS. 9 and 10 are respective flow charts for explaining a control sequence according to the present invention.

Turning first to FIG. 9, the air-fuel ratio changing conditions are determined by the map shown in FIG. 6, and the warm-up correction is performed. The air-fuel ratio at $\alpha=1$ is set as the reference air-fuel ratio. Otherwise, an air-fuel ratio is determined by multiplying the correction coefficient K from the map with the reference air-fuel ratio. If the target air-fuel ratio is equal to or larger than the stoichiometric or theoretical air-fuel ratio, the air-fuel ratio sensor 28 is used to perform feedback control. However, if the air-fuel ratio is smaller than the theoretical air-fuel ratio, open loop control is performed.

Referring again to FIG. 9, after system initialization is performed in step P1, intake air quantity Q and engine speed R are read in step P2. A basic fuel injection quantity $T_B$ is calculated using the intake air quantity Q and the engine speed R. The injection quantity $T_B$ corresponds to $\lambda=1$. In step P4, the correction coefficient K is read out from the memory. The correction coefficient K is determined by reading out the target air-fuel ratio from the map of FIG. 6 according to the current operating conditions, and addressing the map of FIG. 7 using the readout target air-fuel ratio.

The engine cooling water temperature W is read in step P5. In step P6, the correction coefficient K in step P4 is corrected according to the water temperature W. More specifically, as previously mentioned, if the cooling water temperature is less than 50° C., the correction coefficient K is corrected to a value corresponding to the target air-fuel ratio "13". If the cooling water temperature falls between 50° C. and 70° C., the correction coefficient K is corrected to a value corresponding to "14.7". If the cooling water temperature is up 70° C., no correction is performed in step P6. In other words, the value set in step P4 is used without correction.

The microcomputer checks in step P7 whether the correction coefficient K is larger than 1, i.e., whether the target air-fuel ratio is larger than the theoretical air-fuel ratio. If YES in step P7, open loop control is performed. In this case, the flow advances to step P8 and a feedback correction term $C_{FB}$ is set to zero in step P8. In step P9, the basic fuel injection quantity $T_B$ (step P3) is multiplied with the correction coefficient K to obtain a product corresponding to the target air-fuel ratio, and the product is then added to the feedback correction term $C_{FB}$ to obtain final fuel injection quantity $T_P$. In step P10, the microprocessor waits until a predetermined fuel injection timing is reached. In step P11, the fuel injection quantity $T_P$ is output. The amount of fuel injected from the fuel injection valve 26 is controlled by controlling the duty ratio of the pulse supplied thereto. Therefore, the duty ratio corresponds to the output $T_P$.

If NO in step P7, on the other hand, feedback control is to be performed. In this case, a slice level S, as shown in FIG. 4, corresponding to the correction coefficient K, i.e., the target air-fuel ratio is read out from the map in step P12. Subsequently, an output L from the air-fuel ratio sensor 28 is fetched by the microprocessor in step P13, which may determine in step P14 whether $S=L$ is established. If YES in step P14, the feedback correction term $C_{FB}$ is not corrected, and the flow advances to step P9. However, if NO in step P14, the microprocessor checks in step P15 whether $S>L$ is satisfied. If YES in step P15, the actual air-fuel ratio is higher than the target air-fuel ratio. In step P16, the feedback correction term $C_{FB}$ is decreased. However, if NO is step P15, the actual air-fuel ratio is lower than the target air-fuel ratio, and the feedback correction term $C_{FB}$ is increased. The operations after steps P16 and P17 are the same as those after step P9 described above.

Figure 10:
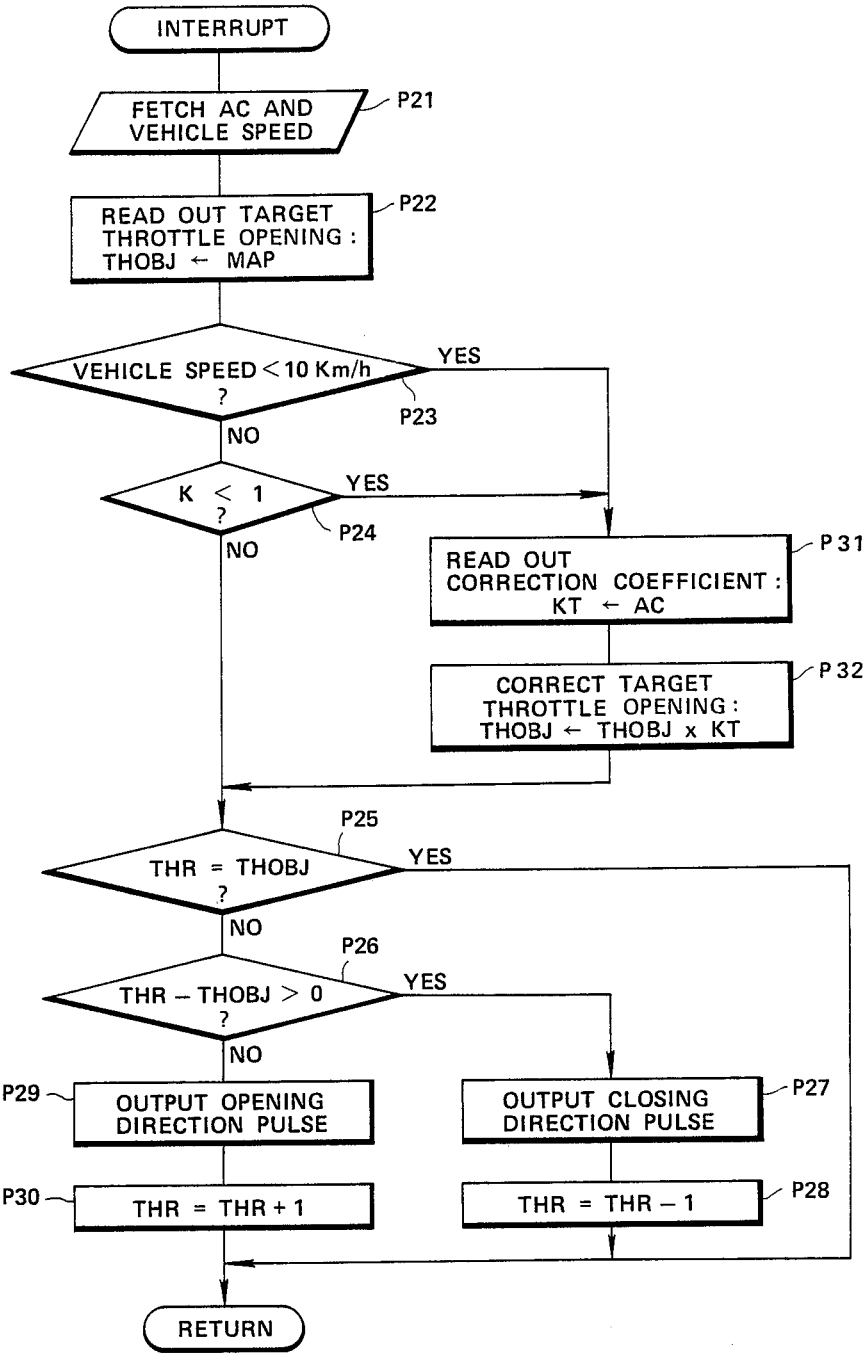

Turning now to FIG. 10, processing in the flow chart thereof is executed upon interruption of the main flow chart of FIG. 9 for every predetermined time interval.

In the flow chart of FIG. 10, if a target air-fuel ratio is equal to or larger than the theoretical air-fuel ratio, the first throttle opening is used. If the target air-fuel ratio is less than the theoretical air-fuel ratio, the second throttle opening is used. In this case, the first throttle opening is used as a reference ratio for determining the second throttle opening. The second throttle opening is selected unconditionally at the time of starting of the automobile. Whether the vehicle is going to start is determined by judging whether the vehicle speed exceeds 10 km/h. In addition, throttle control is always performed by feedback control so as to open the throttle valve at a desired opening. Since the stepping motor 48 is used as a drive means for the feedback control, a sensor for detecting the throttle opening of the valve 25 need not be used, but the angular position, or the throttle opening, of the stepping motor 48 is detected by the number of pulses applied thereto.

As shown in FIG. 10, an accelerator position AC and the vehicle speed are fetched by the microprocessor in step P21. In step P22, a reference throttle opening THOBJ corresponding to a reference accelerator position AC is read from the map in FIG. 3.

The microprocessor determines in step P23 whether the vehicle speed is less than 10 km/h. If NO in step P23, the flow advances to step P24. In step P24, the microprocessor determines whether $K<1$ is satisfied, i.e., whether the target air-fuel ratio is equal to or less than the theoretical air-fuel ratio.

If NO in step P24, i.e., if the current air-fuel ratio represents a rich mixture ("13" in this embodiment), the microprocessor determines in step P25 whether a current throttle opening THR is equal to the target throttle opening THOBJ. If YES in step P25, control is finished. However, if NO in step P25, the microprocessor determines in step P26 whether the actual throttle opening THR is larger than the target throttle opening THOBJ. If YES in step P26, the stepping motor 48 is driven by one pulse to close the throttle valve 25 in step P27. In step P28, the actual throttle opening THR is decreased by one pulse, and control is ended. However, if NO in step P26, the stepping motor 48 is driven by one pulse to open the throttle valve 25 in step P29. Thereafter, in step P30, the actual throttle opening THR is increased by one pulse and control is ended.

If the microprocessor determines in step P23 that the vehicle speed is lower than 10 km/h or $K<1$ is satisfied in step P24, the flow advances to step P31. In step P31, a correction coefficient KT corresponding to the accelerator position AC is read out from the map in FIG. 8. In step P32, the target throttle opening THOBJ is updated by multiplying the target throttle opening THOBJ in step P22 with the correction coefficient KT. Thereafter, the operations of step P25 and the subsequent steps are performed. In the case of the route via step P31, the target throttle opening THOBJ corresponding to the accelerator position AC is updated to the characteristic (FIG. 2) corresponding to the lean air-fuel ratio.

Figure 11:
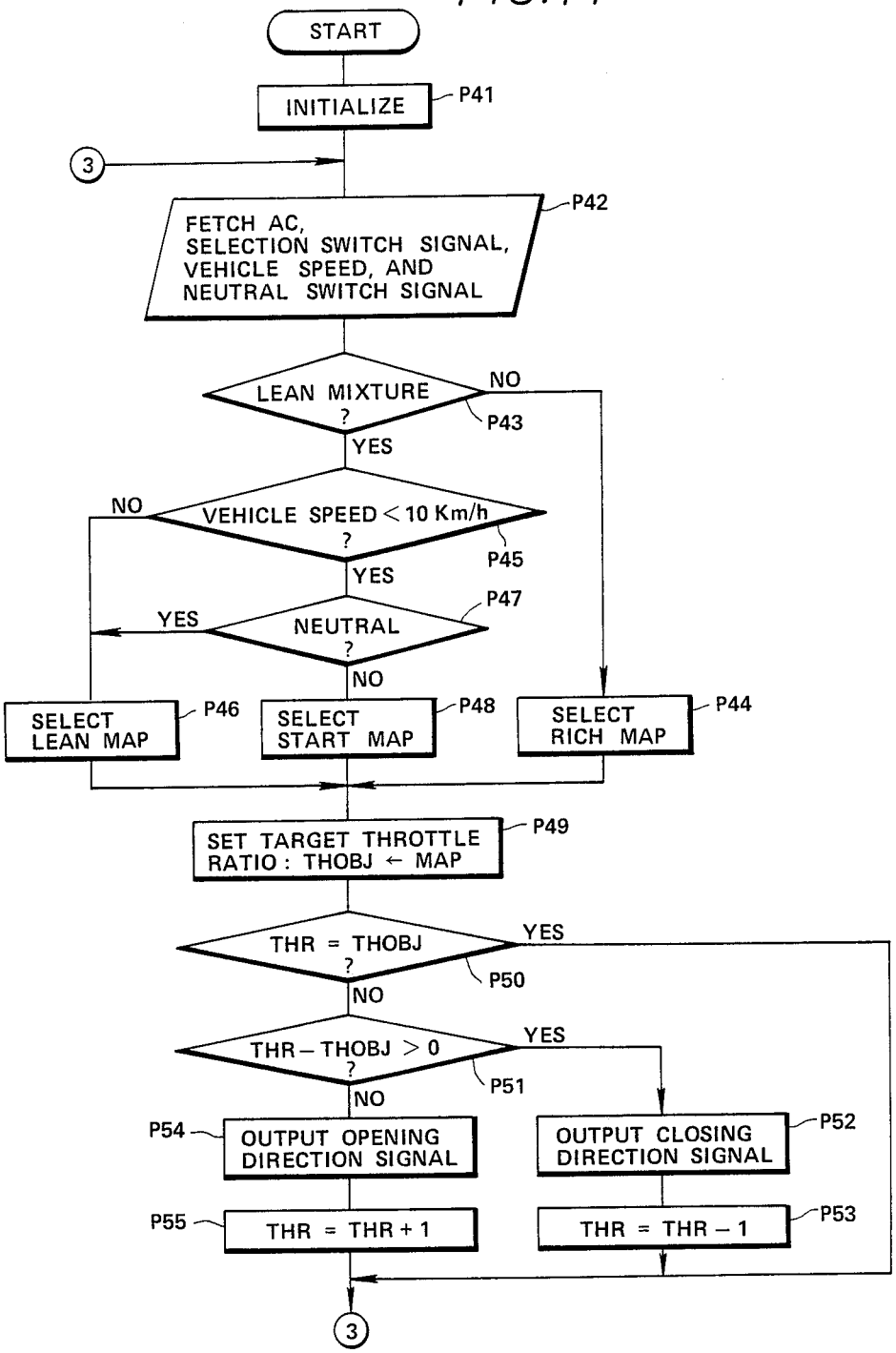
FIG. 11 is a flow chart explaining another control sequence according to the present invention.
Figure 12:
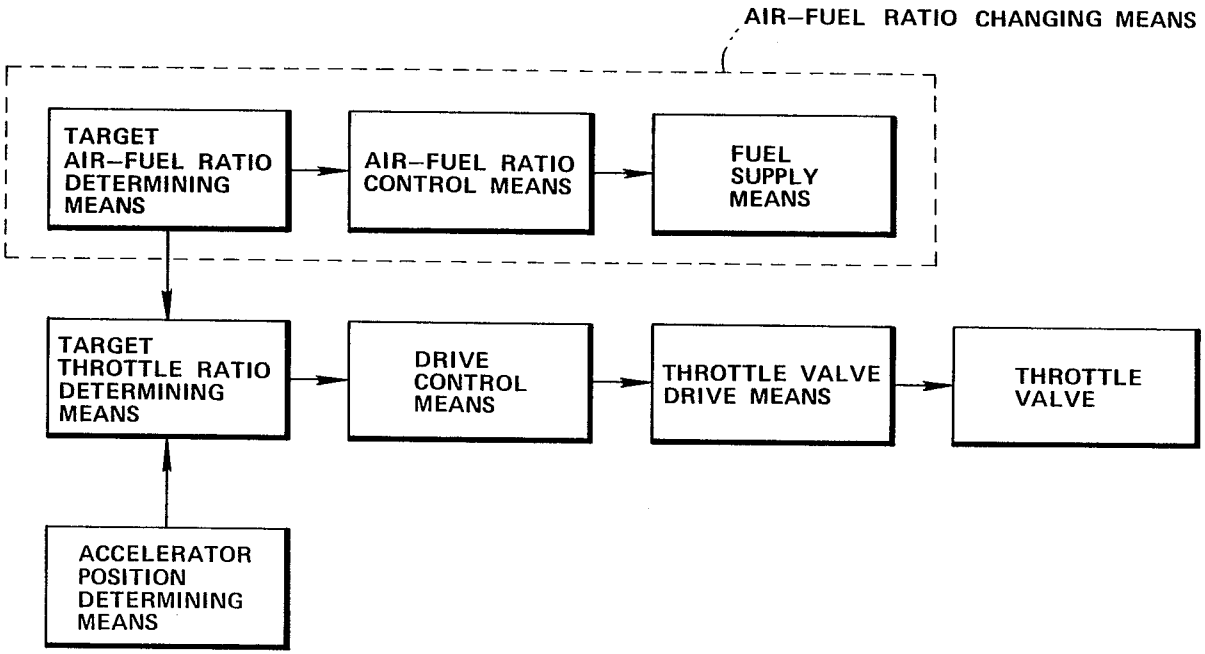
FIG. 12 is a functional block diagram of the throttle valve control apparatus for an engine according to the present invention.

FIG. 11 shows a flow chart describing another control sequence according to the present invention. The air-fuel ratio is updated by the switch 46 to a lean (e.g. $\lambda=1$) or rich mixture (e.g. "13"). It should be noted in this embodiment that the starting state of the vehicle is defined such that the vehicle speed is less than 10 km/h and the transmission is not set in the neutral gear shift position. If the switch 46 designates a lean mixture and the start condition is satisfied, the start throttle opening is selected. More specifically, the start throttle characteristic is as indicated by line S in FIG. 4, and the start throttle opening is quite large for a small accelerator position. Therefore, the driver feels engine power upon starting the automobile. In this embodiment, there is provided a lean map as shown in FIG. 2, a rich map as shown in FIG. 3, and a start map represented by the line S in FIG. 4, but not provided as an independent map.

The system is initialized in step P41. In step P42, the accelerator position AC, and the operation state signals from the switch 46, the vehicle speed switch 44 and the neutral switch 45 are fetched by the microprocessor.

In step P43, the microprocessor determines whether the lean mixture is currently designated. In this case, control of the air-fuel ratio in response to the air-fuel ratio instruction is performed such that the correction coefficient K in step P4 in FIG. 9 is set for lean or rich mixture according to the operation state of the switch 46. If the switch 46 does not designate the lean mixture in step P43, the rich map shown in FIG. 3 is selected in step P44.

Figure 2:
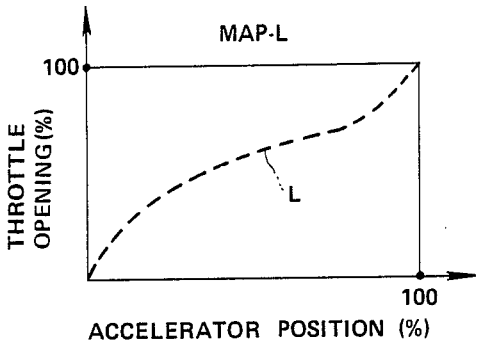
FIG. 2 is a graph showing throttle openings when an air-fuel ratio is large, i.e., the gas mixture is lean.

When the microprocessor determines that the lean mixture is currently designated, the lean map shown in FIG. 2 or the start map shown by line S in FIG. 4 is selected according to the vehicle speed and the transmission gear shift position. More specifically, if the vehicle speed is less than 10 km/h and the transmission is not set in the neutral gear shift position in steps P45 and P47, the start map is selected in step P48. However, if either the vehicle speed exceeds 10 km/h or the transmission is set in the neutral gear shift position, the lean map is selected in step 46.

After the operations in steps P44, P46, and P48, the target throttle opening THOBJ is set according to the map selected in step P49. Thereafter, the operations in step P50 to P55 are performed. These operations are substantially the same as those of step P25 to P30 in FIG. 10 so that a detailed description thereof will be omitted herein.

The present invention has been described with reference to the particular embodiments described hereinabove. However, it should be understood that various changes and modifications may be made within the spirit and scope of claim 1, taken in conjuntion with the embodiments and the accompanying drawings.

We claim:

1. A throttle valve control appartus for an engine, comprising:

air-fuel ratio changing means for changing an air-fuel ratio of a gas mixture supplied to the engine based on a predetermined condition;

a throttle valve arranged in an intake passage of the engine;

throttle valve driving means for driving the throttle valve;

accelerator position detecting means for detecting the opening or position of an accelerator;

target throttle opening determining means for determining a target throttle opening based on a throttle opening characteristic corresponding to the air-fuel ratio of the gas mixture from a plurality of throttle opening characteristic associated so as to allow the throttle opening to be larger with respect to an identical accelerator opening when the air-fuel ratio represents a lean gas mixture than when it represents a rich gas mixture, by receiving outputs from said air-fuel ratio changing means and said accelerator position detecting means; and drive control means for controlling said throttle valve driving means so as to set an opening of said throttle valve to be the target throttle opening determined by said target throttle opening determining means.

2. A throttle valve control apparatus for an engine, comprising:

a throttle valve arranged in an intake passage of the engine;

throttle valve driving means for driving said throttle valve;

accelerator position detecting means for detecting the opening or position of an accelerator;

operating state detecting means for detecting an operating state of the engine;

fuel supply means for supplying fuel to an intake system of the engine;

target air-fuel ratio determining means for determining a target air-fuel ratio corresponding to the operating state detected by said operating state detecting means from the target air-fuel ratios set corresponding to the operating states of the engine;

air-fuel ratio control means for controlling an amount of fuel supplied from said fuel supply means such that an air-fuel ratio of a gas mixture to be supplied to the engine is set to be the target air-fuel ratio determined by said target air-fuel ratio determining means;

target throttle opening determining means for determining a target throttle opening in correspondence to the air-fuel ratio of a gas mixture so as to allow the throttle opening to be larger with respect to an identical accelerator opening when the air-fuel ratio represents a lean gas mixture than when it represents a rich gas mixture, by receiving outputs from said target air-fuel ratio determining means and said accelerator position detecting means; and drive control means for controlling said throttle valve driving means so as to set a opening of said throttle valve to be the target throttle opening determined by said target throttle opening determining means.

3. A throttle valve control apparatus for an engine, comprising:

a throttle valve arranged in an intake passage of the engine;

throttle valve driving means for driving said throttle valve;

accelerator position detecting means for detecting the opening or position of an accelerator;

operating state detecting means for detecting an operating state of the engine;

fuel supply means for supplying fuel to an intake system of the engine;

target air-fuel ratio determining means for determining a target air-fuel ratio corresponding to the operating state detected by said operating state detecting means from the target air-fuel ratios set corresponding to the operating states of the engine;

air-fuel ratio control means for controlling an amount of fuel supplied from said fuel supply means such that an air-fuel ratio of a gas mixture to be supplied to the engine is set to be the target air-fuel ratio determined by said target air-fuel ratio determining means;

target throttle opening determining means for determining a target throttle opening in correspondence to the air-fuel ratio of a gas mixture so as to allow the throttle opening to be larger when the air-fuel ratio represents a lean gas mixture than when it represents a rich gas mixture, by receiving outputs from said target air-fuel ratio determining means and said accelerator position detecting means; and drive control means for controlling said throttle valve driving means so as to set an opening of said throttle valve to be the target throttle opening determined by said target throttle opening determining means, wherein said target throttle opening determining means comprises:

memory means for storing a throttle opening characteristic for the accelerator position as a reference throttle opening characteristic corresponding to a specific target air-fuel ratio, and correcting means for correcting the reference throttle opening derived from the reference throttle opening characteristic according to the target air-fuel ratio determining means.

4. A throttle valve control apparatus for an engine, comprising:

a throttle valve arranged in an intake passage of the engine;

throttle valve driving means for driving said throttle valve;

accelerator position detecting means for detecting the opening or position of an accelerator;

operating state detecting means for detecting an operating state of the engine;

fuel supply means for supplying fuel to an intake system of the engine;

target air-fuel ratio determining means for determining a target air-fuel ratio corresponding to the operating state detected by said operating state detecting means from the target air-fuel ratios set corresponding to the operating states of the engine;

air-fuel ratio control means for controlling an amount of fuel supplied from said fuel supply means such that an air-fuel ratio of a gas mixture to be supplied to the engine is set to be the target air-fuel ratio determined by said target air-fuel ratio determining means;

target throttle opening determining means for determining a target throttle opening in correspondence to the air-fuel ratio of a gas mixture so as to allow the throttle opening to be larger when the air-fuel ratio represents a lean gas mixture than when it represents a rich gas mixture, by receiving outputs from said target air-fuel ratio determining means and said accelerator position detecting means; and drive control means for controlling said throttle valve driving means so as to set an opening of said throttle valve to be the target throttle opening determined by said target throttle opening determining means, wherein said target air-fuel ratio determining means determines at least three target air-fuel ratios; and said target throttle opening determining means comprises:

discriminating means for discriminating whether the target air-fuel ratio determined by said target air-fuel ratio determining means belongs to a first air-fuel ratio representing a relatively rich mixture or to a second air-fuel ratio representing a relatively lean mixture, memory means for storing the throttle opening characteristic corresponding to the accelerator position as a reference throttle opening characteristic corresponding to one of the first and second air-fuel ratios, and correcting means for receiving an output from said discriminating means and for correcting the target throttle opening to the other air-fuel ratio if the target air-fuel ratio determined by said target air-fuel ratio determining means is detected as the other one of the first and second air-fuel ratios.

5. A throttle valve control apparatus for an engine, comprising:

air-fuel ratio changing means for changing an air-fuel ratio of a gas mixture supplied to the engine based on a predetermined condition;

a throttle valve arranged in an intake passage of the engine;

throttle valve driving means for driving the throttle valve;

accelerator position detecting means for detecting the opening or position of an accelerator;

target throttle opening determining means for determining a target throttle opening based on a throttle opening characteristic corresponding to the air-fuel ratio of the gas mixture from a plurality of throttle opening characteristics associated so as to allow the throttle opening to be larger when the air-fuel ratio represents a lean gas mixture than when it represents a rich gas mixture, by receiving outputs from said air-fuel ratio changing means and said accelerator position detecting means; and drive control means for controlling said throttle valve driving means so as to set an opening of said throttle valve to be the target throttle opening determined by said target throttle opening determining means, wherein said air-fuel ratio changing means comprises:

fuel supply means for supplying fuel to an intake system of the engine;

target air-fuel ratio determining means for determining a target air-fuel ratio among a plurality of air-fuel ratio according to the predetermined conditions; and air-fuel ratio control means for controlling an amount of fuel supplied from said fuel supply means such that an air-fuel ratio of a gas mixture to be supplied to the engine is set to be the target air-fuel ratio determined by said target air-fuel ratio determining means, wherein said target air-fuel ratio determining means determines at least three target air-fuel ratios; and said target throttle opening determining means comprises:

discriminating means for discriminating whether the target air-fuel ratio determined by said target air-fuel ratio determining means belongs to a first air-fuel ratio representing a relatively rich mixture or to a second air-fuel ratio representing a relatively lean mixture;

memory means for storing the throttle opening characteristic corresponding to the accelerator position as a reference throttle opening characteristic corresponding to one of the first and second air-fuel ratios; and correcting means for receiving an output from said discriminating means and for correcting the target throttle opening to the other air-fuel ratio if the target air-fuel ratio determined by said target air-fuel ratio determining means is detecting as said other one of the first and second air-fuel ratios.

6. A throttle valve control apparatus for an engine, comprising:

air-fuel ratio changing means for changing an air-fuel ratio of a gas mixture supplied to the engine based on a predetermined condition;

a throttle valve arranged in an intake passage of the engine;

throttle valve driving means for driving the throttle valve;

accelerator position detecting means for detecting the opening or position of an accelerator;

target throttle opening determining means for determining a target throttle opening based on a throttle opening characteristic corresponding to the air-fuel ratio of the gas mixture from a plurality of throttle opening characteristics associated so as to allow the throttle opening to be larger when the air-fuel ratio represents a lean gas mixture than when it represents a rich gas mixture, by receiving outputs from said air-fuel ratio changing means and said accelerator position detecting means; and drive control means for controlling said throttle valve driving means so as to set an opening of said throttle valve to be the target throttle opening determined by said target throttle opening determining means, wherein said air-fuel ratio changing means comprises:

fuel supply means for supplying fuel to an intake system of the engine;

target air-fuel ratio determining means for determining a target air-fuel ratio among a plurality of air-fuel ratio according to the predetermined conditions; and air-fuel ratio control means for controlling an amount of fuel supplied from said fuel supply means such that an air-fuel ratio of a gas mixture to be supplied to the engine is set to be the target air-fuel ratio determined by said target air-fuel ratio determining means, wherein said target throttle opening determining means comprises:

a plurality of memory means for storing throttle opening characteristics in units of target air-fuel ratios; and selecting means for selecting a throttle opening characteristic corresponding to the target air-fuel ratio determined by said target air-fuel ratio determining means, from among the plurality of memory means.

7. An apparatus according to claim 1, wherein said air-fuel ratio changing means comprises:

fuel supply means for supplying fuel to an intake system of the engine;

target air-fuel ratio determining means for determining a target air-fuel ratio among a plurality of air-fuel ratio according to the predetermined conditions; and air-fuel ratio control means for controlling an amount of fuel supplied from said fuel supply means such that an air-fuel ratio of a gas mixture to be supplied to the engine is set to be the target air-fuel ratio determined by said target air-fuel ratio determining means.

8. An apparatus according to claim 2, wherein the operating states of the engine include at least an engine load.

9. An apparatus according to claim 2, wherein the operating states of the engine include an engine cooling water temperature.

10. An apparatus according to claim 2, wherein said target throttle opening determining means comprises:

memory means for storing a throttle opening characteristic for the accelerator position as a reference throttle opening characteristic corresponding to a specific target air-fuel ratio, and correcting means for correcting the reference throttle opening derived from the reference throttle opening characteristic according to the target air-fuel ratio determining means.

11. An apparatus according to claim 2, wherein said target air-fuel ratio determining means determines at least three target air-fuel ratios; and said target throttle opening determining means comprises discriminating means for discriminating whether the target air-fuel ratio determined by said target air-fuel ratio determining means belongs to a first air-fuel ratio representing a relatively rich mixture or to a second air-fuel ratio representing a relatively lean mixture, said target throttle opening determining means being adapted to determine the target throttle opening as one of a rich throttle opening characteristic corresponding to the first air-fuel ratio and a lean throttle opening characteristic corresponding to the second air-fuel ratio.

12. An apparatus according to claim 2, wherein said target air-fuel ratio determining means determines at least three target air-fuel ratios; and said target throttle opening determining means comprises:

discriminating means for discriminating whether the target air-fuel ratio determined by said target air-fuel ratio determining means belongs to a first air-fuel ratio representing a relatively rich mixture or to a second air-fuel ratio representing a relatively lean mixture, memory means for storing the throttle opening characteristic corresponding to the accelerator position as a reference throttle opening characteristic corresponding to one of the first and second air-fuel ratios, and correcting means for receiving an output from said discriminating means and for correcting the target throttle opening to the other air-fuel ratio if the target air-fuel ratio determined by said target air-fuel ratio determining means is detected as the other one of the first and second air-fuel ratios.

13. An apparatus according to claim 12, wherein the target air-fuel ratios determined by said target air-fuel ratio determining means include at least a theoretical or stoichiometric air-fuel ratio, a rich air-fuel ratio lower than the theoretical air-fuel ratio, and a lean air-fuel ratio higher than the theoretical air-fuel ratio, the rich air-fuel ratio belonging to the first air-fuel ratio, and the lean and theoretical air-fuel ratios belonging to the second air-fuel ratio.

14. An apparatus according to claim 12, wherein said target throttle opening determining means comprises:

start detecting means for detecting the starting of a vehicle; and correcting means for receiving an output from said start detecting means and for determining the target throttle opening according to the throttle opening characteristic corresponding to the second air-fuel ratio, regardless of the target air-fuel ratio determined by said target air-fuel ratio determining means.

15. An apparatus according to claim 2, wherein said air-fuel ratio control means comprises an air-fuel ratio sensor for detecting an air-fuel ratio in exhaust gas of the engine and performs feedback control such that an air-fuel ratio of a gas mixture supplied to the engine is set to be the target air-fuel ratio according to an output from said air-fuel ratio sensor if the target air-fuel ratio is at least a specific target air-fuel ratio.

16. An apparatus according to claim 13, wherein said air-fuel ratio control means comprises an air-fuel ratio sensor for detecting an air-fuel ratio in exhaust gas from the engine and performs feedback control such that an air-fuel ratio of the gas mixture supplied to the engine is set to be the target air-fuel ratio according to an output from said air-fuel ratio sensor only if the target air-fuel ratio is the second air-fuel ratio.

17. An apparatus according to claim 7, wherein said target air-fuel ratio determining means of determines at least three target air-fuel ratios; and said target throttle opening determining means comprises:

discriminating means for discriminating whether the target air-fuel ratio determined by said target air-fuel ratio determining means belongs to a first air-fuel ratio representing a relatively rich mixture or to a second air-fuel ratio representing a relatively lean mixture;

memory means for storing the throttle opening characteristic corresponding to the accelerator position as a reference throttle opening characteristic corresponding to one of the first and second air-fuel ratios; and correcting means for receiving an output from said discriminating means and for correcting the target throttle opening to the other air-fuel ratio if the target air-fuel ratio determined by said target air-fuel ratio determining means is detecting as said other one of the first and second air-fuel ratios.

18. An apparatus according to claim 7, wherein said target air-fuel ratio determining means comprises a manual switch.

19. An apparatus according to claim 7, wherein said target throttle opening determining means comprises:

a plurality of memory means for storing throttle opening characteristic in units of target air-fuel ratios; and selecting means for selecting a throttle opening characteristic corresponding to the target air-fuel ratio determined by said target air-fuel ratio determining means, from among the plurality of memory means.

20. An apparatus according to claim 7, wherein said target throttle opening determining means comprises:

start detecting means for detecting the starting of a vehicle; and correcting means for receiving outputs from said start detecting means and said target air-fuel ratio determining means and said target air-fuel ratio determining means and for determining a target throttle opening according to a start special throttle opening characteristic determined such that the target throttle opening is largest at the time of starting of the vehicle.

21. An apparatus according to claim 7 or 2, wherein said fuel supply means comprises a fuel injection valve, an amount of fuel injected from said fuel injection valve being determined by a pulse width of a pulse output from said air-fuel ratio control means to said fuel injection valve.

22. An apparatus according to claim 4, wherein the target air-fuel ratios determined by said target air-fuel ratio determining means include at least a theoretical or stoichiometric air-fuel ratio, a rich air-fuel ratio lower than the theoretical air-fuel ratio, and a lean air-fuel ratio higher than the theoretical air-fuel ratio, the rich air-fuel ratio belonging to the first air-fuel ratio, and the lean and theoretical air-fuel ratios belonging to the second air-fuel ratio.

23. An apparatus according to claim 4, wherein said target throttle opening determining means comprises:

start detecting means for detecting the starting of a vehicle; and correcting means for receiving an output from said start detecting means and for determining the target throttle opening according to the throttle opening characteristic corresponding to the second air-fuel ratio, regardless of the target air-fuel ratio determined by said target air-fuel ratio determining means.

24. An apparatus according to claim 22, wherein said air-fuel ratio control means comprises an air-fuel ratio sensor for detecting an air-fuel ratio in exhaust gas from the engine and performs feedback control such that an air-fuel ratio of the gas mixture supplied to the engine is set to be the target air-fuel ratio according to an output from said air-fuel ratio sensor only if the target air-fuel ratio is the second air-fuel ratio.

* * * * *